United States Patent [19]

Sarcia

[11] 4,339,927

[45] Jul. 20, 1982

[54] GAS-DRIVEN FLUID FLOW CONTROL VALVE AND CRYOPUMP INCORPORATING THE SAME

[75] Inventor: Domenico S. Sarcia, Carlisle, Mass.

[73] Assignee: Oerlikon-Burhle U.S.A. Inc., New York, N.Y.

[21] Appl. No.: 280,291

[22] Filed: Jul. 6, 1981

[51] Int. Cl.[3] ..... F25B 9/00

[52] U.S. Cl. ..... 62/6; 137/25.37

[58] Field of Search ..... 62/6; 137/625.37

[56] References Cited

U.S. PATENT DOCUMENTS

| | | | |
|---|---|---|---|
| 2,906,101 | 9/1959 | McMahon et al. | 62/6 |
| 2,966,035 | 12/1960 | Gifford | 62/6 |
| 3,119,237 | 11/1964 | Gifford | 62/6 |
| 3,188,821 | 6/1965 | Chellis | 62/6 |
| 3,218,815 | 11/1965 | Chellis et al. | 62/6 |
| 3,421,331 | 1/1969 | Webb | 62/6 |
| 3,600,903 | 8/1971 | Chellis | 62/6 |
| 3,609,982 | 10/1971 | O'Neil et al. | 62/6 |
| 3,620,029 | 11/1971 | Longsworth | 62/6 |
| 3,733,837 | 5/1973 | Lobb | 62/6 |
| 3,788,088 | 1/1974 | Dehne | 62/6 |
| 3,853,146 | 12/1974 | Blair | 137/625.37 |
| 4,108,210 | 8/1978 | Luthe et al. | 137/625.37 |

*Primary Examiner*—Ronald C. Capossela

*Attorney, Agent, or Firm*—Schiller & Pandiscio

[57] ABSTRACT

A gas-driven fluid flow control valve capable of responding to a signal to alter the direction of fluid flow therethrough. When the valve is interposed between high- and low-pressure fluid reservoirs on one side and a cryogenic refrigerator requiring the supplying of high-pressure fluid and the discharging of low-pressure fluid on the other side, it may be used to reverse the flow of fluid through the refrigerator to switch it from a cooling to a warming mode. The incorporation of such a refrigerator into a cryopump in conjunction with the gas-driven valve makes it possible to rapidly warm up the condensing and adsorbing surfaces of the cryopump thus reducing the regeneration cycle of the cryopump from several hours to about 30 to 35 minutes.

13 Claims, 8 Drawing Figures

| | OPERATION | VALVE NO. | VALVE POSITION | FLUID IN | FLUID OUT |
|---|---|---|---|---|---|
| 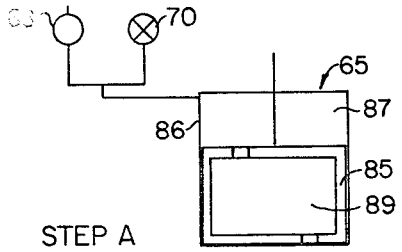  STEP A | COOLING<br>WARMING | 68<br>70<br>68<br>70 | OPEN<br>CLOSED<br>OPEN<br>CLOSED | HP<br>LP | |
| 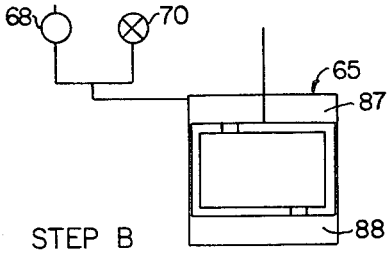  STEP B | COOLING<br>WARMING | 68<br>70<br>68<br>70 | OPEN<br>CLOSED<br>OPEN<br>CLOSED | HP<br>LP | |
| 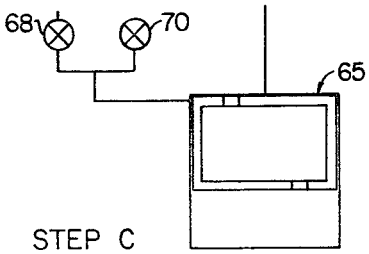  STEP C | COOLING<br>WARMING | 68<br>70<br>68<br>70 | CLOSED<br>CLOSED<br>CLOSED<br>CLOSED | | |
| 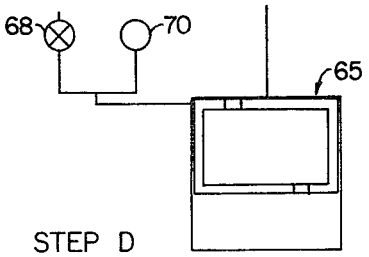  STEP D | COOLING<br>WARMING | 68<br>70<br>68<br>70 | CLOSED<br>OPEN<br>CLOSED<br>OPEN | | LP<br>HP |
| 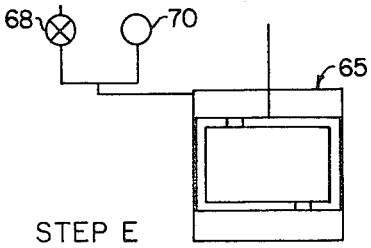  STEP E | COOLING<br>WARMING | 68<br>70<br>68<br>70 | CLOSED<br>OPEN<br>CLOSED<br>OPEN | | LP<br>HP |
| 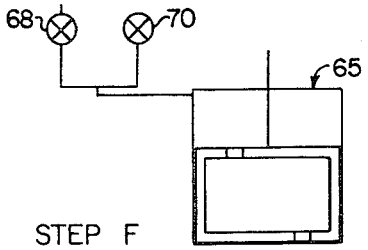  STEP F | COOLING<br>WARMING | 68<br>70<br>68<br>70 | CLOSED<br>CLOSED<br>CLOSED<br>CLOSED | | |

FIG. 7

GAS-DRIVEN FLUID FLOW CONTROL VALVE AND CRYOPUMP INCORPORATING THE SAME

This invention relates to a novel gas driven fourway fluid control valve and more particularly to a fluid control valve suitable for incorporation into a closed-loop cryogenic system including a compressor and a cryogenic refrigerator, to the cryogenic system and to a cryopump serving as a refrigeration load. There are known in the art a class of cryogenic refrigerators based on the Gifford-McMahon cycle as described, for example, in U.S. Pat. Nos. 2,906,101 and 2,966,035. These refrigerators operate on a cycle including the steps of removing and storing heat from a high-pressure fluid during supply along a path to initially cool the fluid, subsequently expanding the initially cooled high-pressure fluid to effect further cooling, and then discharging the cold low-pressure fluid along the same path to receive the heat previously stored. As described in U.S. Pat. No. 2,966,035 the refrigerator may be staged, each succeeding stage being adapted to receive a portion of the fluid and to be maintained at a temperature lower than the preceding one. In this staged form, such refrigerators have been widely used as the refrigeration source for cryopumps. (See for example U.S. Pat. Nos. 3,338,063, 3,485,054 and 4,150,549).

Cryopumps, capable of attaining pressures in the 10-torr range are now used in industrial processing, e.g., vacuum deposition processes and for many types of testing chambers. A cryopump typically combines a vacuum and an ion pump with refrigerated surfaces on which such condensable gases as water vapor, oxygen and nitrogen freeze out and a refrigerated adsorbent such as activated charcoal onto which the noncondensables, e.g., noble gases are adsorbed. Typically the refrigerated surfaces are cooled to about 77° K. and about 20° K. through heat exchange with the fluid in the lower temperature stages of a cryogenic refrigerator, and the adsorbent is maintained at about 20° K. When the adsorbent becomes saturated with noncondensable gases, it is necessary to regenerate the charcoal by removing the adsorbed gases. This is achieved by warming the cryopanel containing the adsorbent to about 77° K. or higher to liberate the adsorbed gases, and then removing those desorbed gases by the mechanical vacuum pump. Getting a 20° K. cryopanel up to 77° K. or higher takes time and in prior devices this operation necessitated shutting down the entire refrigerator, with the result that the condensing surfaces maintained at about 77° K. were also heated thus requiring additional time to return the cryopumps to a pumping condition.

It would therefore be desirable to have means which would make it possible to operate the cryogenic refrigerator incorporated in a cryopump in a manner to automatically cycle the flow of fluid through the refrigerator to attain warming only so long as it was required to desorb the noncondensable from the adsorbent and then to switch back the fluid flow to attain refrigeration.

It is therefore a primary object of this invention to provide a unique gas driven three- or four-way fluid control valve capable of acting upon a signal to switch the flow of high-pressure and lowpressure fluid within a system.

It is another primary object to incorporate a fluid control valve of the character described into the fluid control system of a closed-cycle, mechanically driven cryogenic refrigerator to effect the reversing of the high-pressure/low-pressure flow cycle through the refrigerator and in doing so, provide means for periodically, controllably warming up the refrigerator.

It is yet a further object of this invention to provide a novel cryopump which is automatically recycled to discharge absorbed gases and which is capable of performing the cycle required in a much shorter time than now attainable, thus materially reducing the overall time required to carry out a cryopumping operation. Other objects of the invention will in part be obvious and will in part be apparent hereinafter.

The invention accordingly comprises the features of construction, combinations of elements, and arrangement of parts which will be exemplified in the constructions hereinafter set forth, and the scope of the invention will be indicated in the claims.

According to one aspect of the invention there is provided a gas-driven fluid flow control valve, comprising in combination a valve body with an internal cylindrical bore and having first, second, third and fourth spaced annular grooves in the wall defining the bore, a valve casing lining the wall of the bore, defining with the grooves first, second, third and fourth outer fluid manifolds and having cut therethrough a plurality of first, second, third and fourth radial passages communicating with the first, second, third and fourth outer manifolds, respectively, first and second spaced radial passages from the first outer manifold, a third radial passage from the second outer manifold, fourth and fifth spaced radial passages from the third outer manifold, and a sixth radial passage from the fourth outer manifold through said valve body, each of the radial passages being arranged for connection with separate fluid lines, a valve member slidable within the valve casing to define therein first and second fluid chambers of complementary variable volumes, the valve member having (1) annular grooves in the wall thereof to define with the internal wall of the casing first and second inner axially elongate fluid manifolds, (2) a central fluid passage and (3) first and second radial passages in fluid communication with the central fluid passage, the inner fluid manifolds being spaced and of such a length that when the first fluid chamber is at maximum volume, the first and second outer manifolds are in fluid communication through the first and second plurality of passages with the first inner manifold and the third and fourth outer manifolds are in fluid communication through the third and fourth plurality of passages with the second inner manifold, and when the second fluid chamber is at maximum volume, the first outer manifold is in fluid communication through the first plurality of passages with the first inner manifold, the second and third outer manifolds are in fluid communication through the second and third plurality of passages with the second inner manifold, and the fourth outer manifold is in fluid communication with the second radial passage, thereby providing fluid communication between the forth and first outer manifolds through the axial passage, and force applying means acting upon the valve members to maintain the first fluid chamber at the maximum volume when high-pressure fluid is introduced therein.

According to another aspect of this invention there is provided an improved closed cycle cyrogenic refrigeration system comprising an enclosure, a displacer movable within the enclosure to define therein at least two chambers of variable volume, mechanical means to move the displacer, a fluid flow path connecting the chambers, heat storage means in the fluid flow path, a reservoir of high-pressure fluid, a reservoir of low-pressure fluid, conduit means connecting the high-pressure and the low-pressure reservoirs with the interior of the enclosure, fluid inlet control valve means and fluid discharge control valve means, wherein the improvement comprises a gas-driven fluid flow control valve incorporated into the conduit means connecting the high-pressure and the low-pressure reservoirs with the interior of the enclosure and being arranged, upon gas pressure actuation, to reverse the flow of fluid into the refrigerator from high-pressure to lowpressure fluid and the flow of fluid from the refrigerator from low-pressure to high-pressure fluid whereby the refrigerator is alternately switched between cooling and warming modes of operation.

According to a further aspect of this invention there is provided a cryopump comprising in combination a vessel defining a fluid tight volume; a mechancially driven cryogenic refrigerator means having within the cryopump volume heat station means capable of providing refrigeration to condensing and adsorbing surface means when high-pressure fluid is introduced through valve-controlled conduit means into the refrigerator from a high-pressure fluid source for initial cooling through heat exchange and final cooling through expansion and the resulting low-pressure fluid is discharged through valve-controlled conduit means to a low-pressure reservoir; a gas-driven fluid flow control valve incorporated into the conduit means connecting the high-pressure and the low-pressure fluid sources with the refrigerator and being arranged, upon gas pressure actuation, to reverse the flow of fluid into the refrigerator from high-pressure to low-pressure fluid and the flow of fluid from the refrigerator from low-pressure to high-pressure fluid whereby said refrigerator can alternate between delivering refrigeration and delivering sufficient heat to the condensing and adsorbing surface means to rapidly drive therefrom the gases condensed and adsorbed thereon; temperature sensing means associated with the condensing and adsorbing surface means arranged to provide a signal indicative of the temperature thereof; switch means responsive to the signal; and valve means actuatable by the signal through the switch means, connected to the high-pressure and low-pressure fluid sources through said gas-driven fluid flow control valve, and providing the gas pressure actuation.

For a fuller understanding of the nature and objects of the invention, reference should be had to the following detailed description taken in connection with the accompanying drawings in which.

Figure 1:
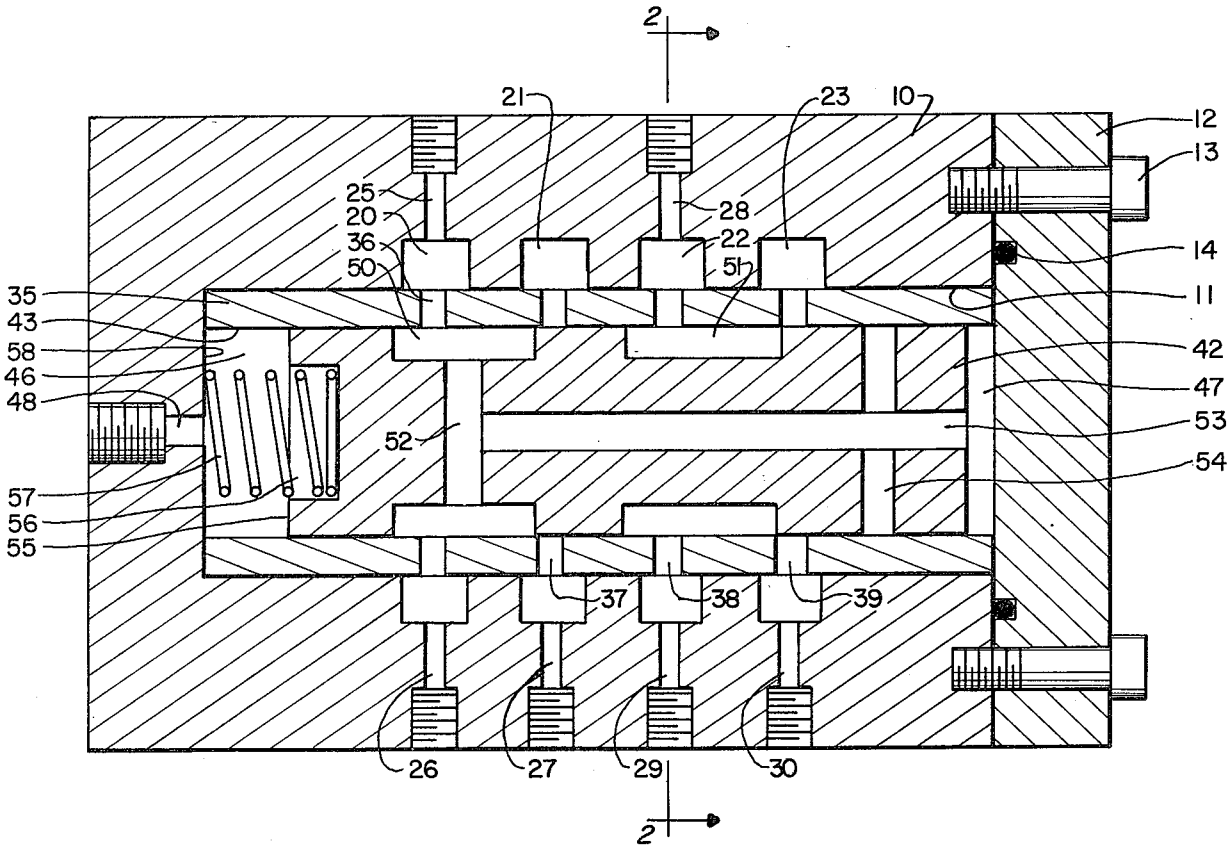
FIG. 1 is a longitudinal cross section of the fluid control valve of this invention.
Figure 8:
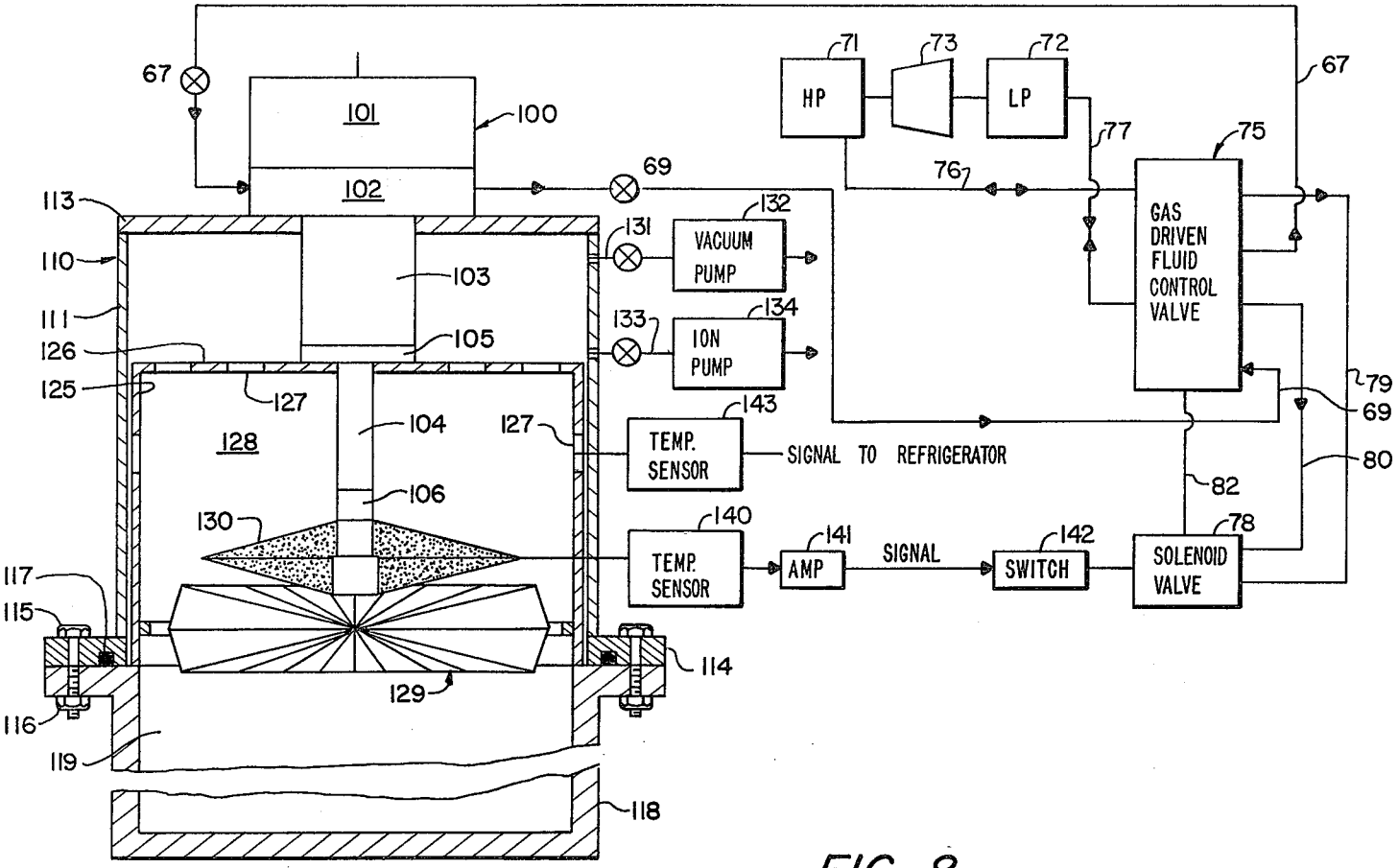

FIG. 7 contrasts the operations of a refrigerator using the Gifford-McMahon cycle when it is switched from a cooling mode to a warming mode by the gas driven valve of FIG. 1; and FIG. 8 diagrams the incorporation of the fluid flow control valve of this invention along with sensing and signal generating means incorporated in the fluid flow path of a staged, cryogenic refrigerator used in a cryopump.

As will be seen from FIG. 1, which is a longitudinal cross section of the gas-driven four-way fluid valve of this invention, the valve comprises a valve body 10 with a central cylindrical bore 11 which is closed off by end plate 12 affixed to valve body 10 through screws 13 and the use of an O-ring seal 14. Cut into the internal wall of bore 11 are spaced annular grooves 20, 21, 22 and 23, groove 20 having spaced radial fluid passages 25 and 26, groove 21 radial fluid passage 27, groove 22 spaced radial fluid passages 28 and 29 and groove 23 radial passage 30. Passages 25-30 are all adapted to be connected to fluid lines such as through threaded connectors not shown.

Figure 2:
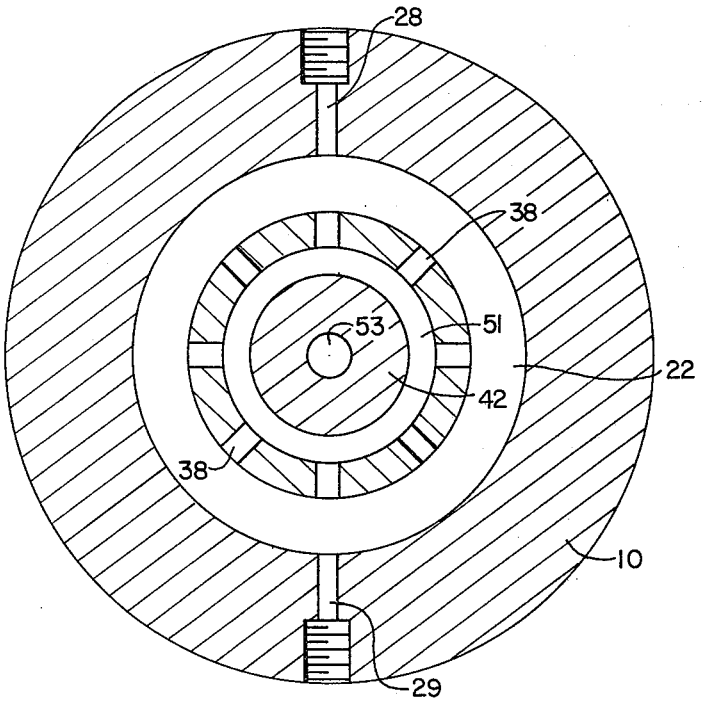
FIG. 2 is a transverse cross section of the valve of FIG. 1 taken through plane 2—2 of FIG. 1.

Bore 11 is lined with a sleeve liner 35 formed of a suitable material, e.g., a ceramic. Liner 35 extends the length of bore 11 and provides an inner wall for grooves 20-23 to form them into fluid manifolds. Cut through liner 35 are a plurality of radial passages for each of the manifolds formed, i.e., passages 36 for manifold 20, passages 37 for manifold 21, passages 38 for manifold 22 and passages 39 for manifold 23. The transverse cross section of FIG. 2 illustrates these passages for manifold 28.

A valve member 42 is slidably movable within liner 35, forming a fluid-tight seal with the inner wall 43 of liner 35. The necessary fluid sealing between inner wall 43 and the external surface of valve member 45 may be attained either through the use of appropriate materials for liner 35 and valve member 45 such that their surfaces are of a character to make sealing contact or through the use of O-ring seals (not shown) appropriately spaced along the length of valve member 42. The axial movement of valve member 42 within liner 35 defines opposed fluid chamber 46 and 47 of complementary volumes. A fluid passage 48 leads from chamber 46 and is adapted for connection to an external fluid line.

Valve member 42 has two spaced axially elongate annular grooves 50 and 51 which define annular fluid manifolds with inner wall 43 of liner 35. A first cross passage 52 is drilled through valve member 42 to connect opposite sides of manifold 50 and an axial passage 53 extends from cross passage 52 through the valve member into chamber 47. A second cross passage 54 is cut through valve member 42 normal to axial passage 53. In that end surface 55 of valve member 42 which partially defines chamber 46, a well 56 is cut to seat in a compression spring 57 which is urged against the end wall 58 of bore 11.

Figure 3:
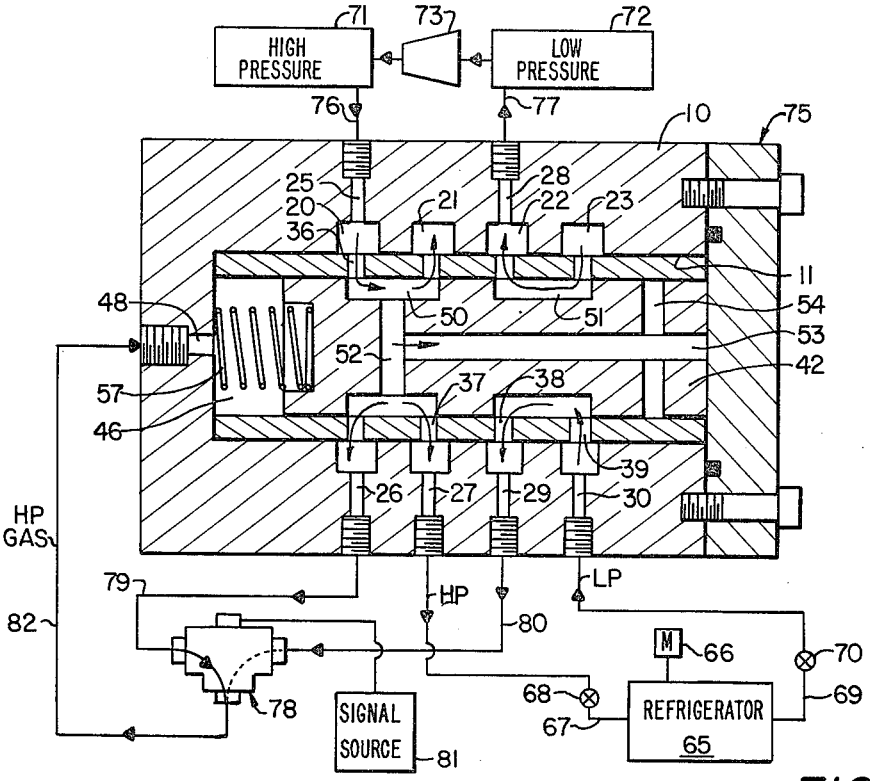
FIG. 3 illustrates, partly in cross section and partly in diagram, the functioning of the valve of FIG. 1 incorporated in the fluid flow path of a refrigerator operating in a cooling mode.
Figure 4:
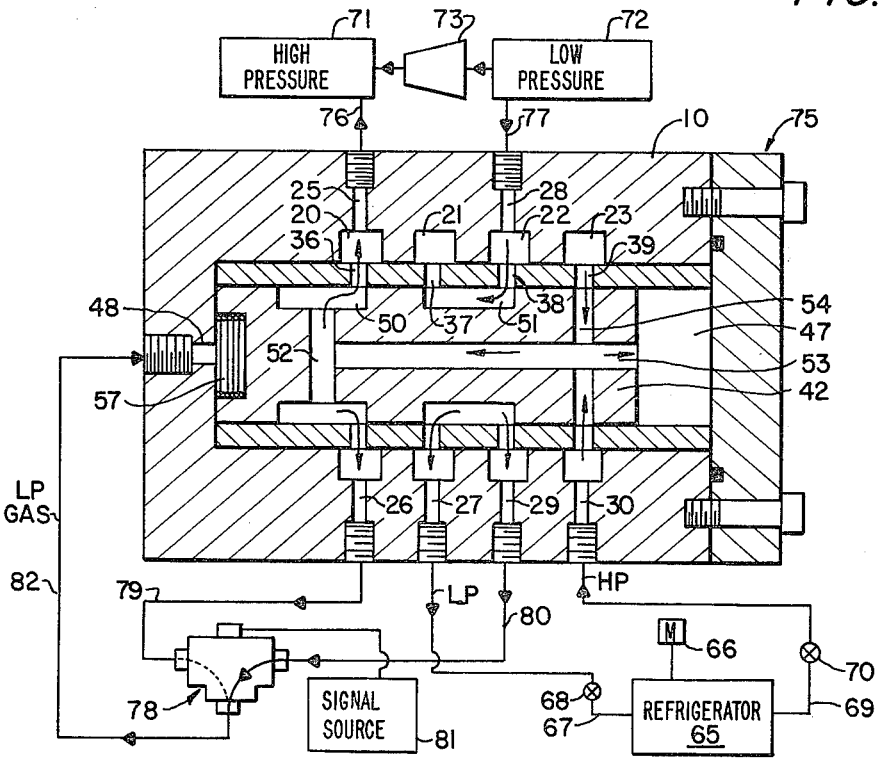
FIG. 4 illustrates, partly in cross section and partly in diagram, the functioning of the valve of FIG. 1 incorporated in the fluid flow path of a refrigerator operating in a warming mode.

The relative locations of manifolds 20-23 and manifolds 50 and 51 as well as of passages 52 and 54 will become apparent from a description of FIGS. 3 and 4 which show the valve member 42 in its two positions corresponding to its two alternative modes of operation—high-pressure intake/low-pressure discharge and low-pressure intake/high-pressure discharge, respectively. In order to better identify the roles of the various manifolds and passages used to describe their relative positions, FIGS. 3 and 4 include diagrammatic representations of a cryogenic refrigerator, fluid supply means and valve actuating means.

In FIGS. 3 and 4, there is provided a cryogenic refrigerator 65 which in the use of the valve of this invention must be mechanically driven by a motor 66. By way of example, refrigerator 65 with its motor 66 may be apparatus as shown in U.S. Pat. Nos. 3,717,004, 3,625,015 and 2,966,034. In accordance with the above-detailed refrigeration cycle, high-pressure fluid is delivered by line 67, controlled by valve 68, and low-pressure fluid is discharged through line 69, controlled by valve 70. Valves 68 and 70 normally form part of the refrigerator and are operated cyclically in synchronism with reciprocal movement of the displacers which form part of the refrigerator. In normal practice, line 67 would extend directly from a high-pressure fluid reservoir 71 and line 69 would extend directly to a low-pressure reservoir 72. Although these reservoirs are shown as separate components, they may, of course, be the high-pressure and low-pressure sides of a compressor 73. Since, however, the purpose of the valve 75, which is interposed between the refrigerator 65 and the fluid reservoirs 71 and 72, is to periodically reverse the flow of fluid to the refrigerator, there is shown separate high-pressure and low-pressure lines 76 and 77, respectively, leading from the valve to the high-pressure and low-pressure reservoirs.

The switch serving as the valve actuating means is shown in FIGS. 3 and 4 to be a three-way solenoid operated switching valve 78 having means to control fluid flow from a high-pressure fluid source, i.e., passage 26, through line 79 and from a low-pressure fluid source, i.e., passage 29 through line 80. Depending upon the signal reaching the solenoid of valve 78 from signal source 81, either high-pressure fluid or low-pressure fluid will be permitted to flow through line 82, communicating with passage 48 into chamber 46.

Figure 5:
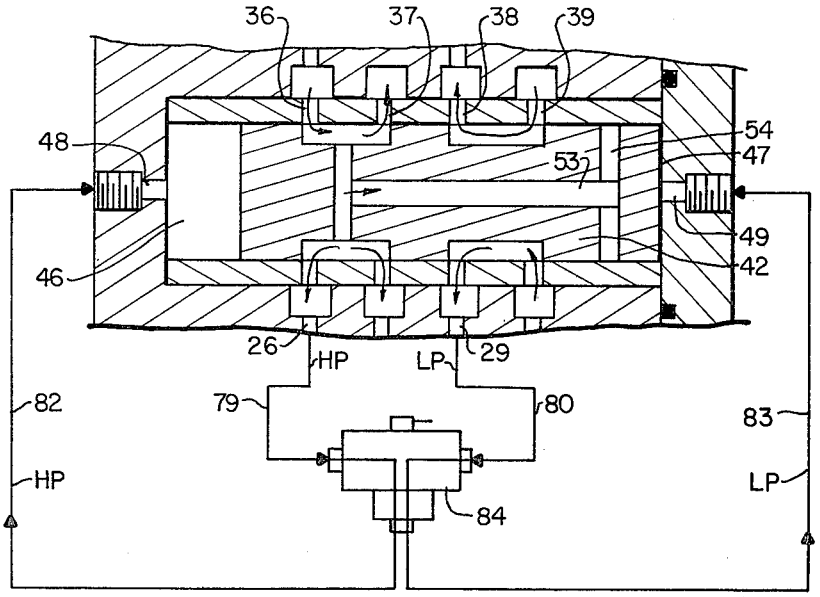
FIGS. 5 and 6 are fragmentary cross sections of a modification of the valve 4 of FIG. 1 showing the use of a four-way switching means which permits the elimination of all supplemental mechanical actuating means to control the valve.
Figure 6:
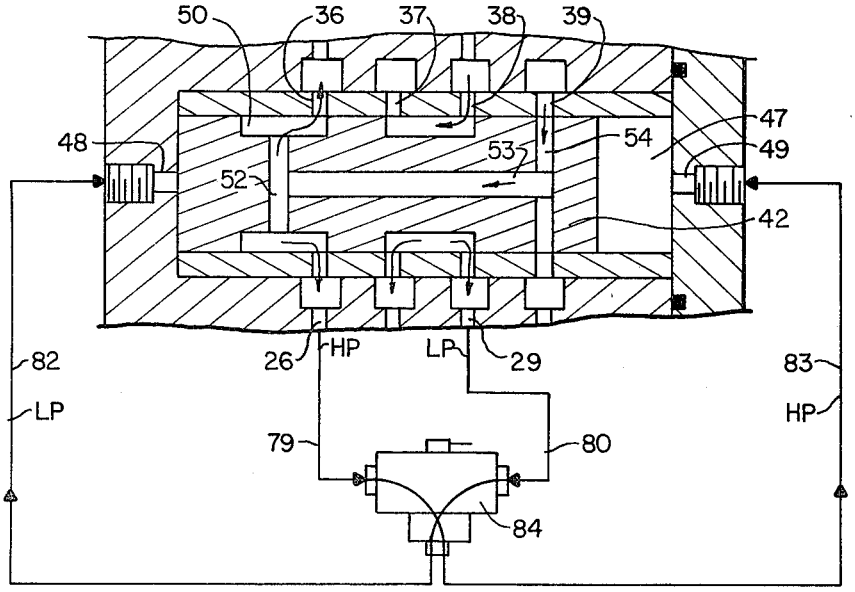

FIGS. 5 and 6 which are fragmentary cross sections of the gas-driven valve corresponding to the positions of valve member 42 shown in FIGS. 3 and 4, respectively, illustrate a modification of the valve of FIG. 1. In this arrangement spring 57 is omitted and means are provided to vary the pressure of the fluid in chamber 47. It will be seen that axial passage 53 is terminated at the point where it communicates with cross passage 54, thus closing off chamber 47 from the high-pressure side of the valve. This then requires a fluid passage 49 leading from chamber 47 for connection to an external fluid line 83 which connects chamber 57 to a four-way solenoid operating switching valve 84. The proper actuation of four-way valve 84 makes it possible not only to change the flow into chamber 46 from high-pressure to low-pressure fluid, but also to change the fluid flow through line 83 from low-pressure to high-pressure, thus bringing about the introduction of high-pressure fluid into chamber 47 and driving the valve member to the left, i.e., from its position in FIG. 5 to that in FIG. 6.

The apparatus of FIG. 3 or 5 is shown in the cooling or refrigeration mode of operation, i.e., high-pressure intake/low-pressure discharge. As will be seen, the high-pressure fluid in chamber 46, with or without the added force of spring 57 (FIG. 3 or FIG. 5) is sufficient to force valve member 42 all of the way to the right, i.e., the volume of chamber 46 is at maximum and that of chamber 47 is at a minimum, that is essentially zero. In this position, manifold 50 is in fluid communication with both manifolds 20 and 21; manifold 51 is in fluid communication with both manifolds 22 and 23; and cross passage 54 is in essence blocked off. These fluid connections allow high-pressure fluid flow through line 76 and into passage 25, around manifold 20, through passages 36 into manifold 50 and out through passages 26 and 27, with that flowing to passage 26 going by way of line 79 to the switch valve means 78 and that by way of passage 27 into line 67 to refrigerator 65 when valve 68 is open. Low-pressure fluid from refrigerator 65 will flow, when valve 70 is open, through line 69, and passage 30 into manifold 23 and from there through passages 39 into manifold 51 from where it will flow by way of passages 38 into manifold 22 for distribution through passage 29 and line 80 to switching valve means 78, and through passage 28 and line 77 into low-pressure reservoir 72. High-pressure fluid continues to fill cross passages 52 and 54 and axial passage 53. So long as switching means 78 remains in that position which allows high-pressure fluid to fill chamber 46, the refrigerator will be maintained in its cooling mode and refrigeration at the lowest designed temperature or temperature levels will be delivered to a load.

However, when signal source 81 provides a second signal, e.g., a signal derived from a temperature sensing means, that the flow of fluid through refrigerator 65 is to be reversed, switching means 78 effects the cutoff of high-pressure fluid to line 82 and permits the flow of low-pressure fluid from manifold 22 to be carried by way of passage 29, line 80, switch 79, line 82, and passage 48 into chamber 46. In the embodiment of FIG. 3 the force of spring 57 is so chosen that it is less than the force of the high-pressure fluid in cross passages 52 and 54 and axial passage 53 so that when high pressure fluid enters chamber 47 it drives valve member 42 to the left and brings chamber 47 to its maximum and chamber 46 to its minimum, i.e., essentially zero. This brings the system into its warming mode, that is low-pressure intake/high-pressure discharge as illustrated in FIG. 4 in which the same reference numerals are used to identify the same components in FIG. 3.

In the case of the embodiment of FIG. 5, the four-way switch valve 84 effects a complete reversal of the flow of fluid so that high-pressure fluid from passage 26 is carried through lines 79 and 83 into chamber 47 while low-pressure fluid from passage 28 is taken by way of lines 80 and 82 into chamber 46. The net effect is to shift the position of valve body 42 from that shown in FIG. 5 to that shown in FIG. 6.

In its position illustrated in FIG. 4, the valve 75 continues to deliver high-pressure fluid to switching valve 78 but not to chamber 46. In the embodiment of FIG. 6, switching valve 84 allows this high-pressure fluid to enter chamber 47. With the shifting of valve member 42 to the left, manifold 51 is in fluid communication with only manifold 20; while manifold 51 is in fluid communication with manifolds 21 and 22 and cross passage 54 is in fluid communication with manifold 23. This arrangement opens up manifold 21 to the low-pressure fluid side of the system, in contrast to the situation obtaining in the operational mode shown in FIG. 3; and it opens up manifold 23 to the high-pressure fluid side of the system contrary to the arrangement of FIG. 3. This then means that low-pressure fluid from reservoir 72 is delivered to refrigerator 65 through passage 28, manifold 22, passages 38 manifold 51, passages 37, manifold 21, passage 27 and line 67 when valve 68 is opened. Likewise, high-pressure fluid is discharged from the refrigerator, when valve 70 is opened, through line 69, passage 30, manifold 23, passages 39, cross passage 54, axial passage 53, cross passage 52, manifold 50, passages 36, manifold 20, passage 25 and line 76.

Thus it will be seen that the inner manifolds 50 and 51 are spaced and of such a length that when fluid chamber 46 is at its maximum volume, i.e., open to the high-pressure side of the system, outer manifolds 20 and 21 are in field communication through radial passages 36 and 37 and outer manifolds 22 and 23 are in fluid communication through radial passages 38 and 39; and when fluid chamber 47 is at its maximum volume, i.e., chamber 46 is open to the low-pressure side of the system and fluid chamber 47 is open to the high-pressure side, outer manifolds 21 and 22 are in fluid communication through radial passages 37 and 38 and outer manifolds 20 and 23 are in fluid communication through radial passages 36 and 39, cross passages 52 and 54 and axial passages 53. As will be seen in FIGS. 3 and 4, by switching from high-pressure fluid to low-pressure fluid in chamber 46, the fluid introduced into refrigerator 65 through line 67 and valve 68 is switched from high-pressure to low-pressure enabling the refrigerator to switch from a cooling to a warming mode of operation as diagrammed in FIG. 7.

The refrigerator 65 of FIG. 7, represented in simple diagrammatic form, is shown operating on the Gifford-McMahon cycle of U.S. Pat. No. 2,906,101. Displacer 85 is caused to move within a housing 86 by mechanical means (not shown) to define therein chambers 87 and 88 of variable and complementary volumes. A heat storage means 89, e.g., a regenerator, is interposed between chambers 87 and 88 in the fluid flow path. In keeping with this well-known refrigeration cycle, high-pressure fluid is introduced into chamber 87 as displacer 85 is moved up. (Steps A and B). During transfer to chamber 88 the high-pressure fluid is initially cooled in regenerator 89. With the attainment of full volume in chamber 88 (Step C), the low-pressure valve 70 is opened (Step D) allowing the high-pressure fluid to expand, cool further and receive heat previously stored as it is forced out of chamber 88 (Step E) to attain the position in the cycle (Step F) to enable it to start over again.

In the warming mode, the valves 68 and 70 are operated as before, but since low-pressure fluid is taken in movement of displacer 85 effects compression, initial warming and removal of heat from regenerator 85 and discharge of high-pressure fluid.

FIG. 8 illustrates the application of the gas-driven fluid control valve of this invention to a cryopump. Refrigerator 100 is a mechanically driven device of the character previously described and is shown to have a header cap 101, and header body 102 into which fluid is delivered through line 67 and discharged through line 69. The refrigerator is shown to have two stages 103 and 104, the former typically delivering refrigeration through a heat station 105 at about 77° K. and the latter delivering refrigeration through a heat station 106 at about 20° K. Refrigerator 100 is integrated into a cryopump generally indicated by the reference numeral 110.

Cryopump 110 comprises a cylindrical vessel 111 closed off at one end by support plate 113, attached to refrigerator header body 102, and provided at its opposite end with a flange 114. Flange 114 is adapted to be hermetically coupled by bolts 115, nuts 116 and a seal 117 to the flange of a second vessel 118 which may be designed to serve as a working zone 119 in wwhich a load (specimen, sample, electronic component or the like) is maintained at a selected low temperature and pressure. Mounted within vessel 111 is a radiation shield 125 in the form of a cylinder closed on top by an end wall 126 and open at its bottom end. The walls of shield 125 have a plurality of openings 127 cut therethrough to allow free passage of gas in and out of shield volume 128. Radiation shield 125 is made of a metal having a high reflectively and high thermal conductivity. The first stage heat station 105 of the refrigerator is in thermal contact with end wall 126 of radiation shield 125. Attached to the lower end of radiation shield 125 and extending across its open end is a conventional chevron baffle 129. Located just above chevron 129 and attached to heat station 106 of the second colder stage of the refrigerator is a cryopanel 130 which consists of two mutually confronting frustoconical casings made of a multiperforated material, e.g., a fine metal screen, and filled with comminuted charcoal. As is believed obvious, the shield 125 and chevron 129 are at the approximately 77° K. of heat station 105, while cryopanel 130 is at approximately the 20° of heat station 106. The vessel 111 (or alternatively the vessel 118) is connected via a valve-controlled line 131 to a rough mechanical vacuum pump 132, and optionally through another valve-controlled line 133 to an ion pump 134.

In the usual operation the chambers of vessels 111 and 118 are intially evacuated by operation of pumps 132 and 134 and then while the latter are still operating, the chambers are cryopumped by condensation of gases on the cold surfaces of chevron 129, cryopanel 130 and shield 126. Water vapor freezes out on the 77° K. surfaces, while oxygen and nitrogen solidify on the outer surfaces of the 20° K. cryopanel 268. Any incondensable gases such as the noble gases that may be present are absorbed by the charcoal particles in cryopanel 130.

A rise in temperature experienced by the cryopanel surface 130 may be used to indicate the need for regeneration of the cryopumping surface. Such a rise in temperature comes about when the adsorbent becomes saturated or poisoned with adsorbed noncondensable and with condensed water vapor. Alternatively, when the cryopanel needs regeneration there is a rise in pressure and this may be sensed as the indication for the need for regeneration. Under these conditions, the active material in cryopanel 130 will no longer cryosorb and the gases which should be adsorbed will remain in volume 128 with the result that the conductive load in the cryopanel will be increased bringing about an increase in temperature.

In using the gas-driven valve of this invention, a suitable temperature sensor 140, e.g., a carbon or germanium resistive transducer, is connected to cryopanel 130 and the temperature signal received is sent to an amplifier 141 to generate a signal transmitted to a switch unit 142. When the temperature of cryopanel 130 rises a selected amount, the signal from amplifier 141 causes switch unit 142 to energize the solenoid of valve 78 so that the flow of high-pressure fluid is cut off to chamber 46 (FIG. 3 or 5) and low-pressure enters it (FIG. 4 or 6). This then switches the refrigerator from its cooling mode to warming mode. As an example of such an operation, a rise in temperature of cryopanel 130 from 20° K. to 24° K. may be used to cause switch 142 to initiate the warming of cryopanel 130 to drive off the gases adsorbed by the adsorbent. When the cryopanel surface reaches about 140° K., switch unit 142 is programmed to deenergize the solenoid of valve 78, so that high-pressure fluid is again sent into chamber 46 to reverse gas-driven valve 25 to that mode of operation illustrated in FIG. 3 or 5 and to return the refrigerator back to its cooling mode. With the return of the introduction of high-pressure fluid into the refrigerator 100, heat stations 105 and 106 are rapidly returned to their cryopumping temperatures of about 77° K. and 20° K., respectively.

As an alternative to using the attainment of an upper temperature level by cryopanel 130 to activate switch 142 to deenergize the solenoid of valve 78 to return the system to a cooling mode, it is possible to incorporate a time delay mechanism in switch 142 to effect reversing of valve 78 a predetermined time after the refrigerator has been switched into its warming mode. Such devices are well known.

Switch 142 is also preferably used to open the solenoid valve in line 131 leading to vacuum pump 132 so that the desorbed gases from cryopanel 130 may be pumped out. Likewise, during the period of desorption, if there is a gate valve (not shown) between volume 128 and working zone 119, it will preferably be closed upon actuation by switch 142 or by some intermediate mechanism controlled by switch 142. With the return of the refrigerator to the cooling mode, the valve in line 131 will again be closed and the internal gate valve will again be opened.

It has been found that the temperature of heat station 106 can be raised from 70° K. to 140° K. in about 15 minutes and that it can likewise be lowered from 140° K. to 70° K. in about 15 minutes, giving a cold-to-cold cycle time of about 30 minutes. In contrast to this very short cycle period, it requires some five to six hours to bring the temperature of heat station 106 from 70° K. to 300° K. and some two to three hours to bring it to 150° K. by shutting off the refrigerator.

During sustained operation of an efficient cryopump the buildup of gases in the adsorbent surface takes place much more rapidly than the buildup of condensed vapors on the radiation shield and chevron surfaces. This, in turn, means that the cryopanel surface must be regenerated many times before it is necessary to regenerate those surfaces normally maintained at about 77° K. Therefore, as an optional addition to the system of this invention there may be included a secondary temperature sensor 143 arranged to sense the temperature of a condensing surface, i.e., the surface of radiation shield 126 or chevron 129 and to send a suitable signal to the refrigerator driving means and valve means to cease operation of the refrigerator so that the cryopump may warm up to an appropriate level, e.g., room temperature, so that the condensing surface may also be purged. Since such complete purging is required only at extended intervals, the use of the gas-driven valve of this invention in a closed-loop cryogenic system including a cryopump as the cryogenic load makes possible the very rapid heat up of the refrigerator which in turn results in a much shorter recycling time for the cryopump. This means, of course that the cryopump may be used in actual cryopumping for a much larger percent of its operation time.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

What is claimed is:

1. A gas-driven fluid flow control valve, comprising in combination:

(a) a valve body with an internal cylindrical bore and having first, second, third and fourth spaced annular grooves in the wall defining said bore;

(b) a valve casing lining said wall of said bore, defining with said grooves first, second, third and fourth outer fluid manifolds and having cut therethrough a plurality of first second, third and fourth radial passages communicating with said first second, third and fourth outer manifolds, respectively;

(c) first and second spaced radial passages from said first outer manifold, a third radial passage from said second outer manifold, fourth and fifth spaced radial passages from said third outer manifold and a sixth radial passage from said fourth outer manifold through said valve body, each of said radial passages being arranged for connection with separate fluid lines;

(d) a valve member slidable within said valve casing to define therein first and second fluid chambers of complementary variable volumes, said valve member having (1) annular grooves in the wall thereof to define with the internal wall of said casing first and second inner axially elongate fluid manifolds, (2) a central fluid passage and (3) first and second radial passages in fluid communication with said central fluid passage, said inner fluid manifolds being spaced and of such a length that when said first fluid chamber is at maximum volume said first and second outer manifolds are in fluid communication through said first and second plurality of passages, with said first inner manifold and said third and fourth outer manifolds are in fluid communication through said third and fourth plurality of passages with said second inner manifold, and when said second fluid chamber is at maximum volume said first outer manifold is in fluid communication through said first plurality of passages with said first inner manifold, said second and third outer manifolds are in fluid communication through said second and third plurality of passages with said second inner manifold, said fourth outer manifold is in fluid communication with said second radial passage thereby providing fluid communication between said fourth and first outer manifolds through said axial passage; and (e) force applying means acting upon said valve members to maintain said first and second fluid chambers alternately at said maximum volumes.

2. A fluid flow control valve in accordance with claim 1 wherein said valve member and said casing are formed of a ceramic the contacting walls thereof forming a fluid tight seal therebetween.

3. A fluid flow control valve in accordance with claim 1 wherein said force applying means comprises a spring in compression located in said first chamber.

4. A fluid flow control valve in accordance with claim 1 wherein said force applying means comprises means to provide high-pressure and low-pressure fluid alternately to said first chamber and simultaneously to provide low-pressure and high-pressure fluid alternately to said second chamber.

5. In a closed cycle cryogenic refrigeration system comprising an enclosure, a displacer movable within said enclosure to define therein at least two chambers of variable volume, mechanical means to move said displacer, a fluid flow path connecting said chambers, heat storage means in said fluid flow path, a reservoir of high-pressure fluid, a reservoir of low-pressure fluid, conduit means connecting said high-pressure and said low-pressure reservoirs with the interior of said enclosure, fluid inlet control valve means and fluid discharge control valve means, the improvement comprising a gas-driven fluid flow control valve incorporated into said conduit means connecting said high-pressure and said low-pressure reservoirs with said interior of said enclosure and being arranged, upon gas pressure actuation, to reverse the flow of fluid into said refrigerator from high-pressure to low-pressure fluid and the flow of fluid from said refrigerator from low-pressure to high-pressure fluid whereby said refrigerator is alternately switched between cooling and warming modes of operation.

6. A cryogenic refrigeration system in accordance with claim 5 including valve means responsive to an externally provided signal, connected to said high-pressure and said low-pressure reservoirs through said gas-driven fluid flow control valve, and providing said gas pressure actuation.

7. A cryogenic refrigeration system in accordance with claim 5 wherein said gas-driven, fluid flow control valve comprises in combination:

(a) a valve body with an internal cylindrical bore and having first, second, third and fourth spaced annular grooves in the wall defining said bore;

(b) a valve casing lining said wall of said bore, defining with said grooves first, second, third and fourth outer fluid manifolds and having cut therethrough a plurality of first, second, third and fourth radial passages communicating with said first, secnd, third and fourth outer manifolds, respectively;

(c) a first passage from said first outer manifold communicating with said high-pressure fluid reservoir; a second passage from said first outer manifold communicating with said valve means; a third passage from said second outer manifold communicating with said interior of said enclosure; a fourth passage from said third outer manifold communicating with said low-pressure fluid reservoir; a fifth passage from said third outer manifold communicating with said valve means; and a sixth passage from said fourth outer manifold communicating with said interior of said enclosure;

(d) a valve member slidable within said valve casing to define therein first and second fluid chambers of complementary variable volumes, said valve member having (1) annular grooves in the wall thereof to define with the internal wall of said casing first and second inner axially elongate fluid manifolds, (2) a central fluid passage and (3) first and second radial passages in fluid communication with said central fluid passage, said inner fluid manifolds being spaced and of such a length that when said first fluid chamber is at maximum volume said first and second outer manifolds are in fluid communication through said first and second plurality of passages with said first inner manifold and said third and fourth outer manifolds are in fluid communication through said third and fourth plurality of passages with said second inner manifold, and when said second fluid chamber is at maximum volume said first outer manifold is in fluid communication through said first plurality of passages with said first inner manifold, said second and third outer manifolds are in fluid communication through said second and third plurality of passages with said second inner manifold, said fourth outer manifold is in fluid communication with said second radial passage thereby providing fluid communication between said fourth and first outer manifolds through said axial passage; and (e) force applying means acting upon said valve member to maintain said first and second fluid chambers alternately at said maximum volumes.

8. A cryopump comprising in combination:

(a) a vessel defining a fluid-tight volume;

(b) a mechanically driven cryogenic refrigerator means having within said cryopump volume heat station means capable of providing refrigeration to condensing and adsorbing surface means when high-pressure fluid is introduced through valve-controlled conduit means into said refrigerator from a high-pressure fluid source for initial cooling through heat exchange and final cooling through expansion and the resulting low-pressure fluid is discharged through valve-controlled conduit means to a low-pressure reservoir;

(c) a gas-driven fluid flow control valve incorporated into said conduit means connecting said high-pressure and said low-pressure fluid source with said refrigerator and being arranged, upon gas pressure actuation, to reverse the flow of fluid into said refrigerator from high-pressure to low-pressure fluid and the flow of fluid from said refrigerator from low-pressure to high-pressure fluid whereby said refrigerator can alternate between delivering refrigeration and delivering sufficient heat to said condensing and adsorbing surface means to rapidly drive therefrom the gases adsorbed thereon;

(d) temperature sensing means associated with said condensing and adsorbing surface means arranged to provide a signal indicative of the temperature thereof;

(e) switch means responsive to said signal; and (f) valve means, actuatable by said signal through said switch means, and connected to said high-pressure and low-pressure fluid sources through said gas-driven fluid flow control valve, for providing said gas pressure actuation.

9. A cryopump in accordance with claim 8 wherein said heat station means provide refrigeration at about 77° K. to one portion of said condensing surface means and at about 20° K. to the other portion of said condensing means and to said adsorbing surface means.

10. A cryopump in accordance with claim 9 wherein said temperature sensing means is associated with said other portion of said condensing means and said adsorbing means and said switch means is arranged to respond to cause said valve means to deliver said heat when said temperature reaches about 70° K. and to deliver said refrigeration when said temperature reaches about 140° K.

11. In a method of cryopumping in which noncondensable gases are adsorbed on an adsorbent maintained alternately at a cryogenic temperature sufficiently low to effect adsorption and at a temperature sufficiently high to effect desorption of said gases, and in which said cryogenic temperature is provided by a thermodynamic cycle comprising the steps of (a) supplying a high-pressure fluid along a path, (b) removing and storing heat from said high-pressure fluid during said supplying along said path to intitially cool said fluid, (c) subsequently expanding said initially cooled high-pressure fluid to effect further cooling, and (d) then discharging the resulting cold low-pressure fluid along said path to receive heat previously stored, the flow of fluid being mechanically controlled,; the improvement comprising the step of periodically reversing the flow of fluid in said thermodynamic cycle whereby the reversed cycle comprises supplying low-pressure fluid along said path to initially warm said fluid, subsequently compressing said initially warmed low pressure fluid to effect further heating and then discharging the resulting hot high-pressure fluid along said path to receive heat previously stored.

12. A method in accordance with claim 11 wherein said step of periodically reversing the flow of fluid comprises alternately directing a stream of said high-pressure fluid and a stream of said low-pressure fluid to a gas-driven fluid control valve arranged to alternately effect said supplying of said high-pressure fluid and said low-pressure fluid along said path.

13. A method in accordance with claim 12 including the steps of sensing the temperature of said adsorbent thereby to develop a signal when said adsorbent attains a predetermined temperature, and using said signal to actuate switching valve means arranged to effect said alternately directing said stream of said high-pressure and said stream of said low-pressure fluid to said gas-driven fluid control valve.

* * * * *